US006707430B2

(12) United States Patent
Sakaguchi et al.

(10) Patent No.: US 6,707,430 B2
(45) Date of Patent: Mar. 16, 2004

(54) STRUCTURE FOR SUPPORTING ANTENNA

(75) Inventors: Katsuya Sakaguchi, Tokyo (JP); Toyoshi Saito, Tokyo (JP)

(73) Assignee: NEC Corporation, Tokyo (JP)

( * ) Notice: Subject to any disclaimer, the term of this patent is extended or adjusted under 35 U.S.C. 154(b) by 0 days.

(21) Appl. No.: 10/091,469

(22) Filed: Mar. 7, 2002

(65) Prior Publication Data

US 2002/0126053 A1 Sep. 12, 2002

(30) Foreign Application Priority Data

Mar. 8, 2001 (JP) ..... 2001-065032

(51) Int. Cl.[7] ..... H01Q 1/24
(52) U.S. Cl. ..... 343/702; 343/906
(58) Field of Search ..... 343/702, 906, 343/888, 900

(56) References Cited

U.S. PATENT DOCUMENTS

| | | | | | |
|---|---|---|---|---|---|
| 4,462,033 | A | | 7/1984 | Grashow et al. | 343/715 |
| 5,229,784 | A | | 7/1993 | Jones | 343/888 |
| 5,949,386 | A | * | 9/1999 | Elliott | 343/906 |
| 5,973,645 | A | | 10/1999 | Zigler et al. | 343/702 |
| 6,133,885 | A | * | 10/2000 | Luniak et al. | 343/702 |
| 6,262,693 | B1 | * | 7/2001 | Sutter et al. | 343/895 |
| 6,300,911 | B1 | * | 10/2001 | Murray et al. | 343/702 |

FOREIGN PATENT DOCUMENTS

| | | | | |
|---|---|---|---|---|
| EP | 0 045 373 A1 | 6/1981 | | H01Q/1/32 |
| GB | 896147 | 5/1962 | | |
| GB | 2 064 878 A | 6/1981 | | H01Q/1/32 |
| JP | 62-66702 | 3/1987 | | H01Q/1/48 |
| JP | 9-64635 | 3/1997 | | H01Q/9/22 |
| JP | 9-98008 | 4/1997 | | H01Q/1/24 |
| JP | 10-178311 | 6/1998 | | H01Q/1/24 |
| JP | 11-145712 | 5/1999 | | H01Q/1/10 |
| JP | 2001-177323 | 6/2001 | | |
| WO | WO 98/56063 | 12/1998 | | H01Q/1/08 |

OTHER PUBLICATIONS

United Kingdom Search Report dated Dec. 31, 2002.
United Kingdom Search and Examination Report dated Oct. 14, 2003.

* cited by examiner

*Primary Examiner*—Hoang V. Nguyen
(74) *Attorney, Agent, or Firm*—McGinn & Gibb, PLLC

(57) ABSTRACT

A structure for supporting an antenna is composed of an antenna-supporting member which is formed under a radiator and shaped into a cylinder, an antenna-inserting portion which includes the first cylindrical space for accommodating the antenna-supporting member, locking claws which are connected with a lower end of the antenna-supporting member and interlocked with a lower edge of an inner wall of the first cylindrical space, and a rubber bush which includes a through hole, through which the antenna-supporting member passes, and is inserted between the radiator and the antenna-supporting member. An upper part of the antenna-inserting portion includes the second cylindrical space, which is concentric with the first cylindrical space and has an internal diameter larger than that of the first cylindrical space, and a lower part of the rubber bush fits into the second cylindrical space.

20 Claims, 5 Drawing Sheets

STRUCTURE FOR SUPPORTING ANTENNA

FIELD OF THE INVENTION

The invention relates to a structure for supporting an antenna used in a portable terminal. Although the invention has been developed with the intention of applying the result thereof to a portable terminal such as a cellular telephone, the invention can be widely applied to various appliances using the antenna.

In designing a portable terminal, small-sizeness and light-weightness thereof are regarded as the most important in order to achieve excellent portability. Accordingly, in designing a structure for supporting an antenna used in the portable terminal, small-sizeness and light-weightness thereof are also regarded as the most important. Now, the conventional structures for supporting the antenna used in the portable terminal will be explained referring to FIGS. 1, 2. FIG. 1 shows the conventional structure for supporting the antenna used in the portable terminal, which is provided with locking claws. FIG. 2 shows the other conventional structure for supporting the antenna used in the portable terminal, which is provided with a fixing screw.

The conventional structure for supporting the antenna shown in FIG. 1 is composed of a radiator 1 for radiating electric wave, an antenna supporting member 10 formed under the radiator 1, and an antenna-inserting portion 12 which is formed in a wall of a casing 3 and accommodates the antenna-supporting member 10. The antenna supporting-member 10 is provided with the locking claws 2 which are interlocked with a lower edge of an inner wall of the antenna-inserting portion 12.

The conventional structure for supporting the antenna shown in FIG. 2 is composed of the radiator 1 for radiating electric wave, an antenna-supporting member 13 which is formed under the radiator 1 and provided with a male screw 7 at an upper end thereof, and an antenna-inserting portion 14 which is formed in the wall of the casing 3 and provided with a female screw fitting in the male screw 7.

According to the aforementioned structures, since the antenna can be easily fitted to the casing 3, the portable terminal can be fabricated efficiently. Especially, according to the structure shown in FIG. 1, since the screw is not used therein, there is no apprehension that the screw will become loose because of vibration etc., and the portable terminal can be fabricated within a short period of time as compared with the structure shown in FIG. 2.

Although the structure in which no screw is used is an advantageous one as mentioned in the above, if the dimensions of the antenna-supporting member do not perfectly agree with those of the antenna-inserting portion, there arises an apprehension that ricketiness will occur at interlocking portions therebetween. Moreover, since the portable terminal is required to be cheap as well as small-sized and lightweight, there arises a limitation upon the accuracy in the manufacturing process of the parts of the portable terminal, so that it is very difficult to perfectly eliminate imperfection in the manufacturing process.

Moreover, if the accuracy in the assembling process of the portable terminal is not so high and ricketiness of the antenna cannot be neglected, there arises the possibility that a drop of rainwater adhering to the antenna will enter the inside of the casing.

SUMMARY OF THE INVENTION

Accordingly, it is an object of the invention to provide a structure for supporting an antenna in which an antenna can fit into a casing efficiently and certainly, ricketiness of an antenna can be eliminated, and a waterproof property thereof can be assured.

In order to achieve the aforementioned object of the invention, a structure for supporting an antenna comprises:

- a radiator for radiating electric wave,
- an antenna-supporting member, which is formed under the radiator, and shaped into a cylinder,
- an antenna-inserting portion, which is formed in a wall of a casing, and includes a first cylindrical space for accommodating the antenna-supporting member,
- locking claws, which are connected with a lower end of the antenna-supporting member, and interlocked with a lower edge of a inner wall of the first cylindrical space, and
- a rubber bush, which includes a through hole, through which the antenna-supporting member passes, and is inserted between the radiator and the antenna-inserting portion.

Moreover, an upper part of the antenna-inserting portion includes a second cylindrical space, which is concentric with the first cylindrical space, and has a predetermined depth and an internal diameter larger than that of the first cylindrical space, and a lower part of the rubber bush fits into the second cylindrical space.

Herein, the feature of the invention consists in the structure that the rubber bush having a through hole, though which the antenna-supporting member passes, is provided between the radiator and the antenna-inserting portion formed in the wall of the casing.

That is to say, the feature of the invention consists in the structure that the antenna-supporting member fits into the antenna-inserting portion by a simple procedure without using a screw, and ricketiness of the antenna-supporting member is eliminated. Namely, ricketiness of the antenna-supporting member can be absorbed by inserting the rubber bush between the radiator and the antenna-inserting portion. The rubber bush has elasticity, and is larger than the inner diameter of the second cylindrical space to some extent, so that the rubber bush fulfills the function of applying tension to the antenna-supporting member. According to the aforementioned structure, since the locking claws are interlocked with the lower edge of the inner wall of the first cylindrical space leaving no clearance, ricketiness of the antenna supporting member can be eliminated.

It is desirable that a ring-shaped convex portion is formed on a periphery of a lower end of the rubber bush, and an internal diameter of the ring-shaped convex portion is larger than that of the through hole of the rubber bush. According to the aforementioned structure, since the ring-shaped convex portion fits into the inner periphery of the second cylindrical space tightly, a waterdrop can be prevented from penetrating into the inside of the casing.

Moreover, a circular groove is formed on a bottom surface of the second cylindrical space and along an inner periphery thereof, and the ring-shaped convex portion of the rubber bush fits into the circular groove. According to the aforementioned structure, the waterproof property of the structure for supporting the antenna can be further heightened.

Still more, it is desirable that dimensions of the radiator, the antenna-supporting member, and the rubber bush are selected so that the rubber bush is compressed by the other structural elements.

BRIEF DESCRIPTION OF DRAWINGS

The invention will be explained in more detail in conjunction with appended drawings, wherein.

DESCRIPTION OF PREFERRED EMBODIMENT

Figure 1:
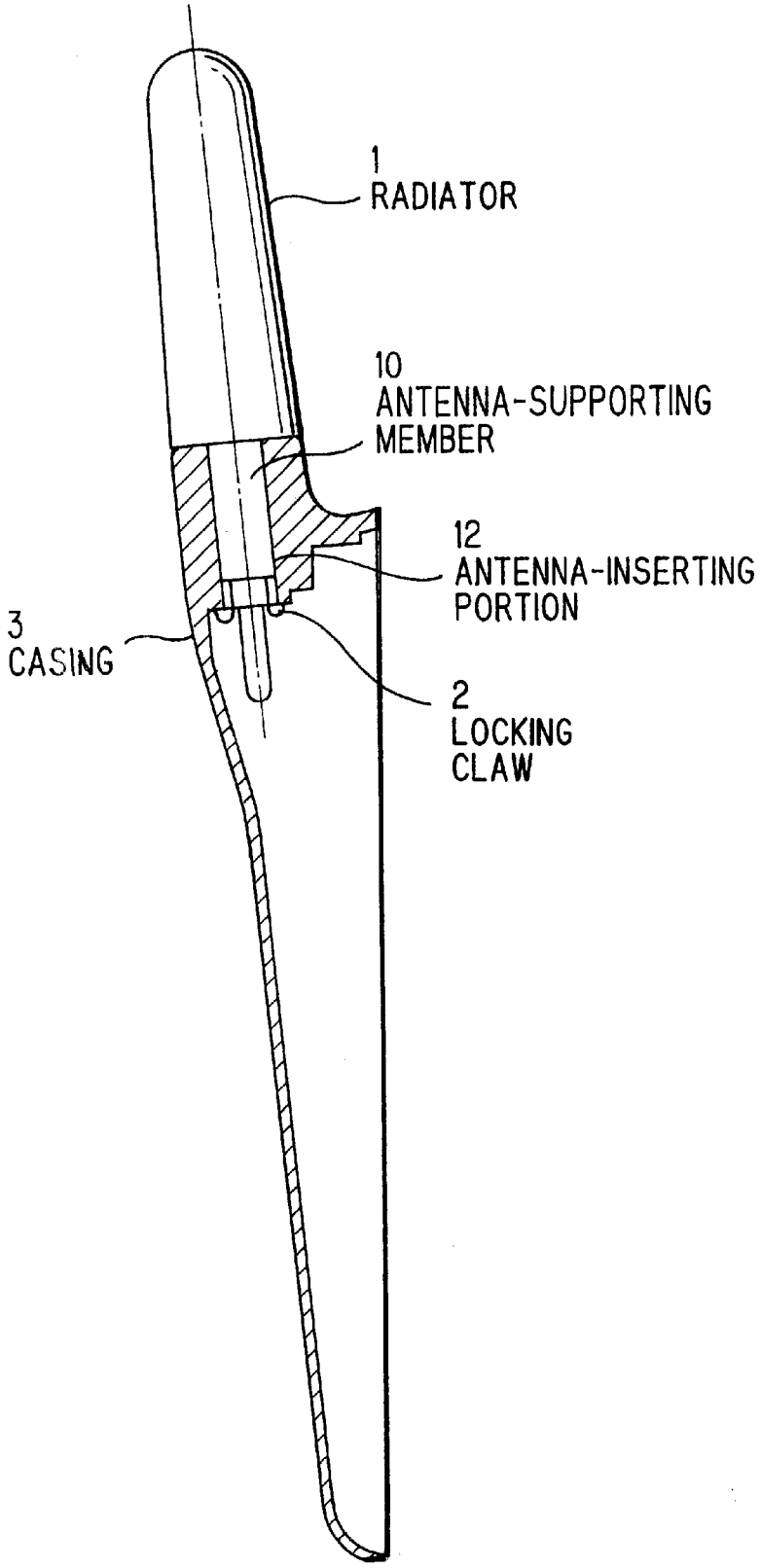
FIG. 1 PRIOR ART
FIG. 1 shows a conventional structure for supporting an antenna using locking claws.
Figure 2:
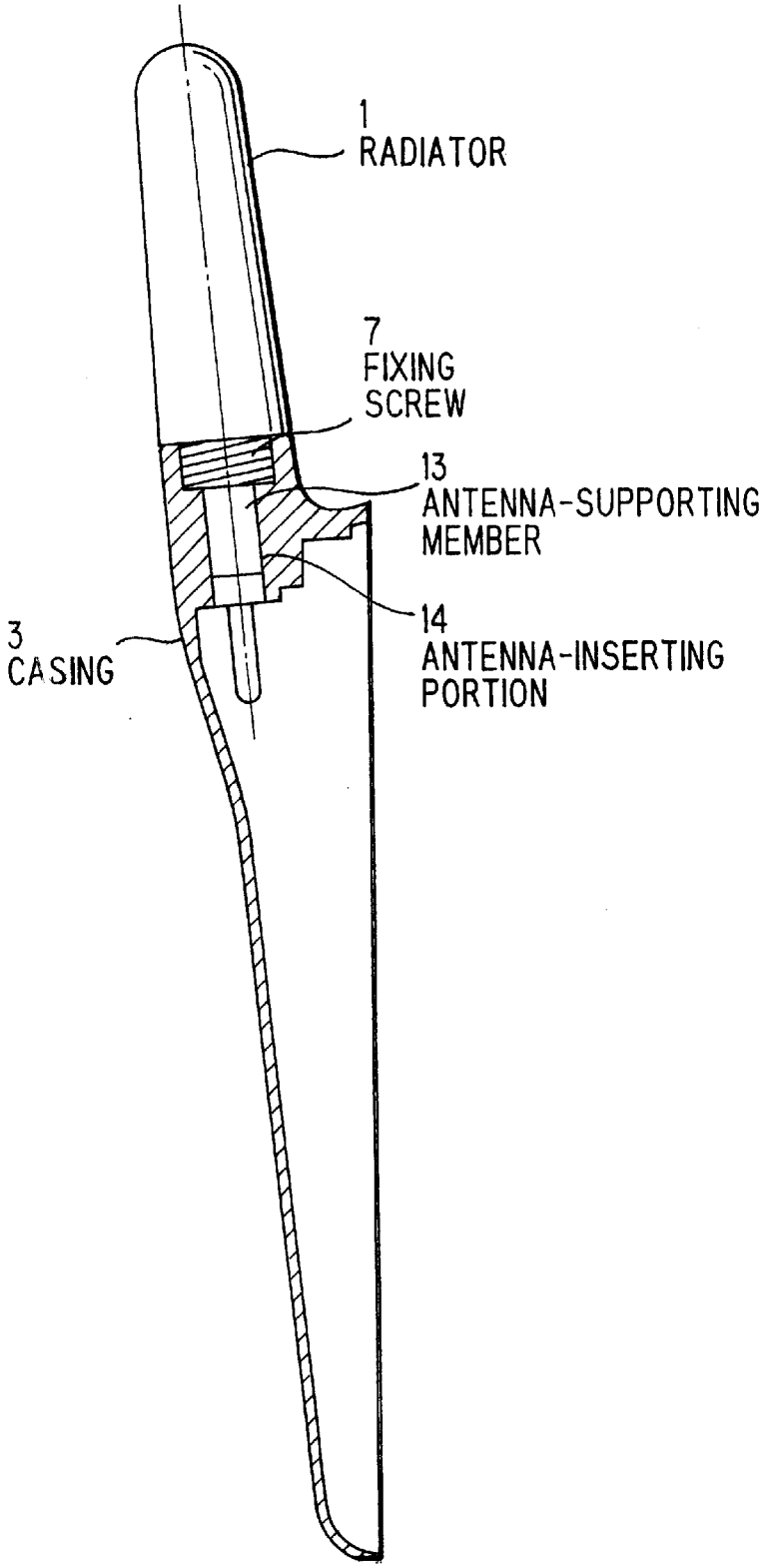
FIG. 2 PRIOR ART
FIG. 2 shows the other conventional structure for supporting an antenna using a fixing screw.
Figure 3:
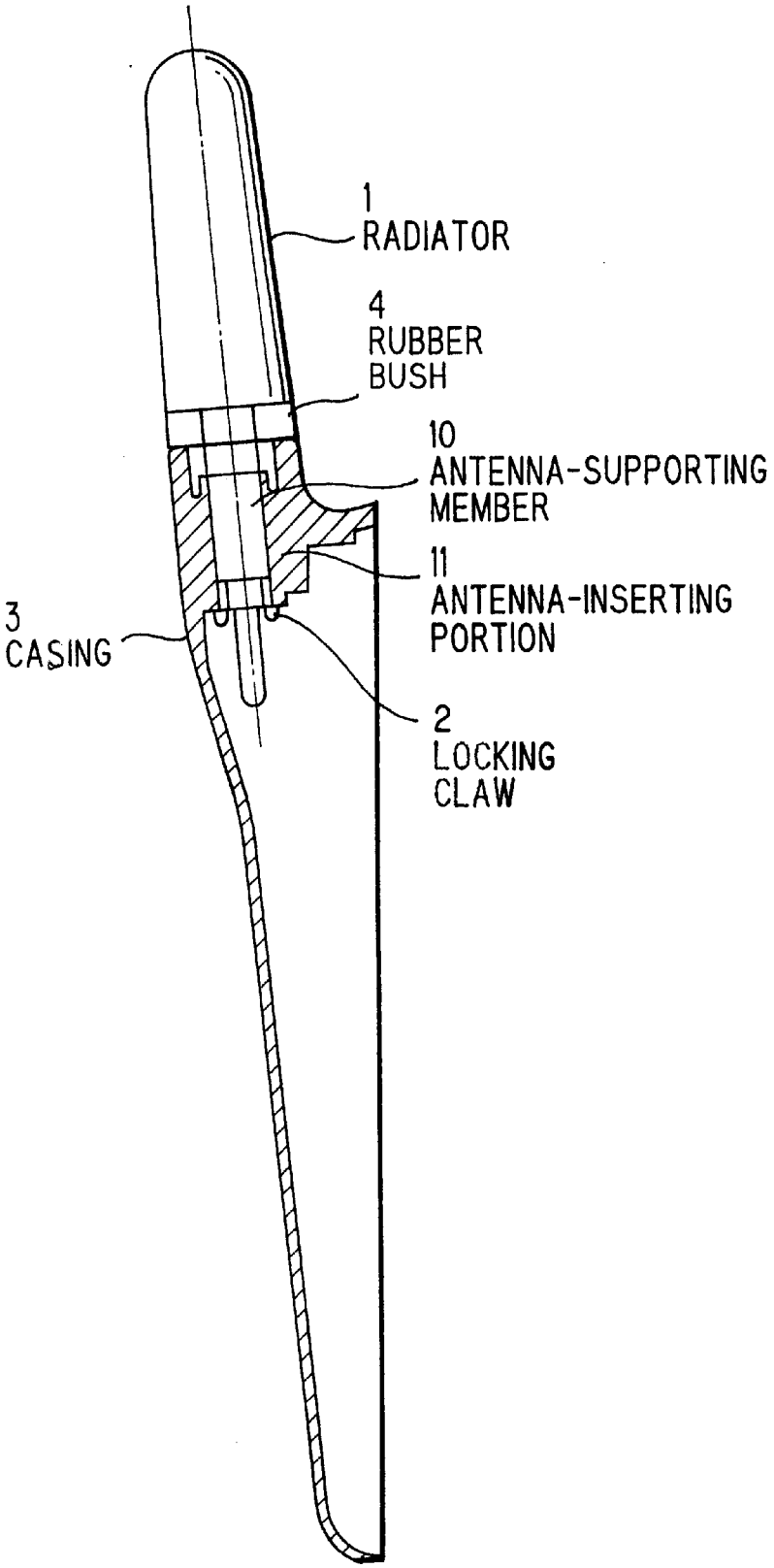
FIG. 3 is a block diagram for showing a structure for supporting an antenna according to a preferred embodiment of the invention.
Figure 4:
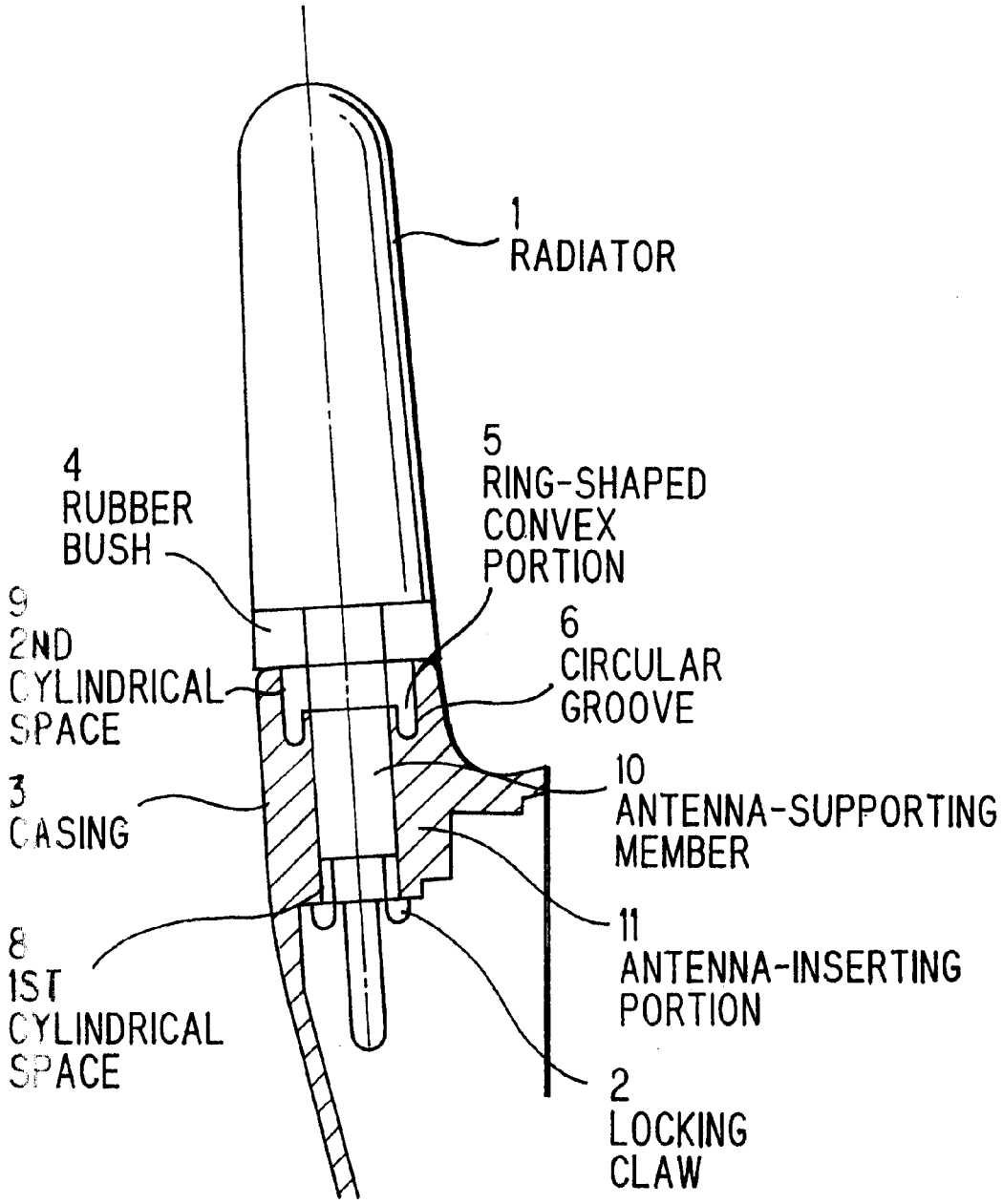
FIG. 4 is an enlarged block diagram for showing a structure for supporting an antenna according to a preferred embodiment of the invention.
Figure 5:
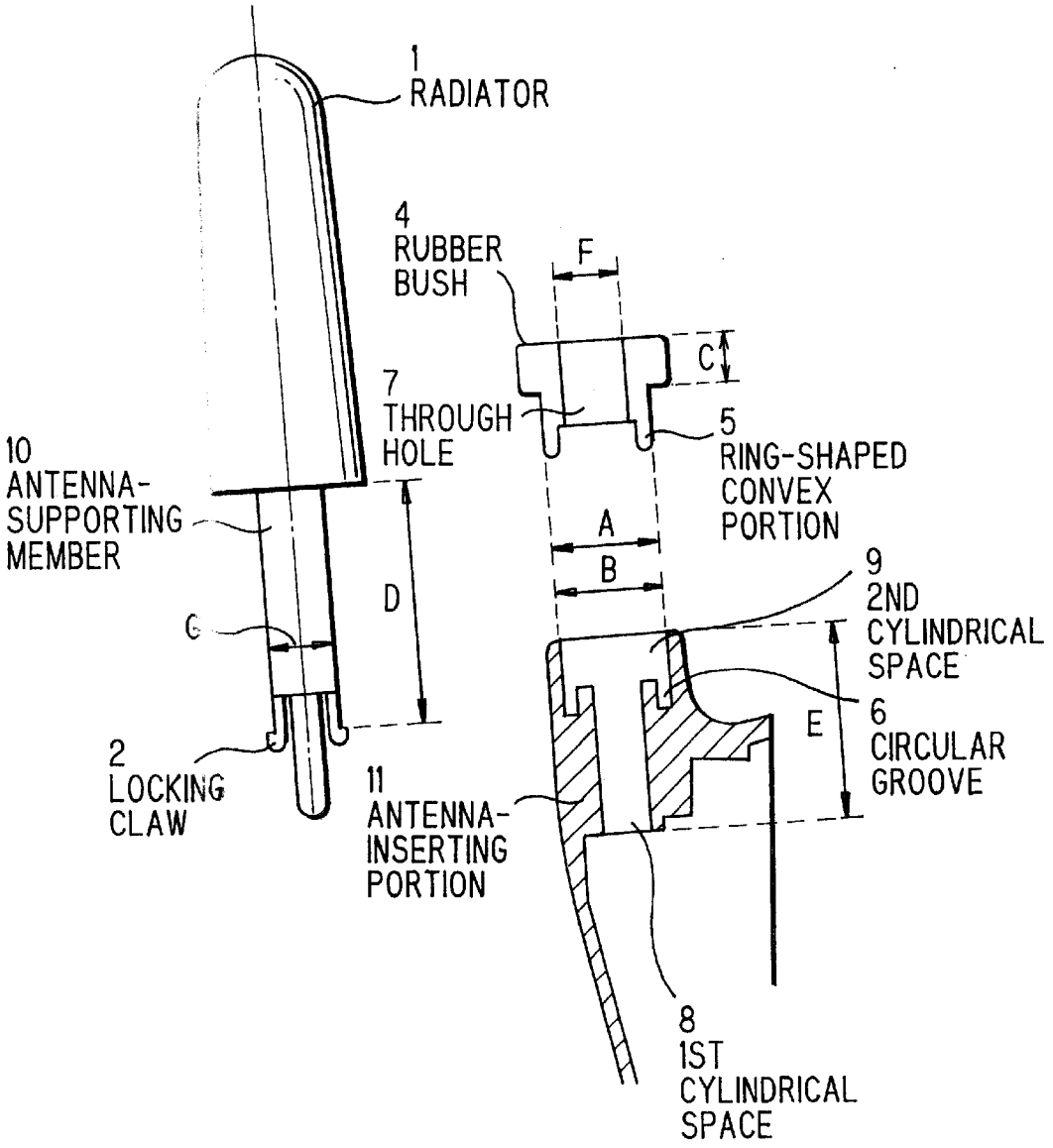
FIG. 5 is a disassembled view for showing dimensions of structural elements of a structure for supporting an antenna according to a preferred embodiment of the invention.

A structure for supporting an antenna according to a preferred embodiment of the invention will be explained referring to FIGS. 3 to 5. FIG. 3 is a block diagram for showing the structure for supporting the antenna according to a preferred embodiment of the invention. FIG. 4 is an enlarged block diagram for showing the structure for supporting the antenna according of the preferred embodiment of the invention. FIG. 5 is a disassembled view for showing dimensions of structural elements of the structure for supporting the antenna according to the preferred embodiment of the invention.

As shown in FIGS. 3 to 5, the structure for supporting the antenna according to the invention includes a radiator 1 for radiating electric wave, an antenna-supporting member 10 which is formed under the radiator 1 and shaped into a cylinder, and an antenna-inserting portion 11 which is formed in a wall of a casing 3 and encircles the antenna-supporting member 10. That is to say, the antenna-supporting member 10 fits into an inner wall of the first cylindrical space 8 which is formed along a central axis of the antenna-inserting portion 11. Locking claws 2 are connected with a lower end of the antenna supporting member 10, and interlocked with a lower edge of the inner wall of the first cylindrical space 8.

Herein, the feature of the embodiment of the invention consists in the structure that a rubber bush 4 is inserted between the radiator 1 and the antenna-inserting portion 11, where a through hole 7, through which the antenna-supporting member 10 passes, is formed around a central axis of the rubber bush 4. Moreover, the second cylindrical space 9 is formed on an upper part of the antenna-inserting portion 11, and a lower part of the bush 4 fits into the second cylindrical space 9. According to the aforementioned structure, since the antenna-supporting member 10 is pulled upward because of elasticity of the rubber bush 4, the locking claws 2 are interlocked with the lower edge of the inner wall of the first cylindrical space 8 leaving no clearance therebetween, and ricketiness of the radiator 1 can be eliminated.

As shown in FIG. 5, a ring-shaped convex portion 5 is formed on a periphery of a lower end of the rubber bush 4, which is brought into contact with a bottom surface of the second cylindrical space 9, where the ring-shaped convex portion 5 is concentric with the through hole 7, and an inner diameter thereof is larger than that of the through hole 7. Moreover, a circular groove 6 is formed on the bottom surface of the second cylindrical space 9 and along an inner periphery thereof, and the ring-shaped convex portion 5 fits into the circular groove 6. According to the aforementioned structure, penetration of rainwater from the antenna-supporting member 10 can be avoided.

As shown in FIG. 5, if the external diameter of the ring-shaped convex portion 5 is denoted by A and the internal diameter of the second cylindrical space 9 is denoted by B, A is slightly larger than B. Then, the thickness of the upper part of the rubber bush 4, which is inserted between the lower end of the radiator 1 and the upper end of the antenna-inserting portion 11, is denoted by C, the length between the lower end of the radiator 1 and the upper end of the locking claw 2 is denoted by D, and the vertical length of the antenna-inserting portion 11 is denoted by E. In the structure shown in FIG. 5, C is slightly larger than D–E. Moreover, the diameter F of the through hole 7 is slightly smaller than the diameter G of the antenna-supporting member 10. According to the aforementioned design, since the rubber bush 4 is suppressed by the surrounding structural elements, such as the radiator 1 and the antenna-inserting portion 11, the physical property of the rubber bush for suppressing penetration of rainwater and ricketiness of the radiator or the antenna-supporting member can be improved.

Although the rubber bush 4 is partially exposed to the outside of the casing 3 in the aforementioned embodiment, a structure that the rubber bush 4 is entirely surrounded with the casing 3 may be adopted. The shape of the groove 6 for improving the waterproof property of the casing 3 is not necessarily restricted to that shown in FIG. 5, and the other shapes of the groove 6 and the rubber bush 4 may be adopted, if rainwater penetrating through clearances is prevented from straightly entering the inside of the casing 3 by the groove 6 and the rubber bush 4 having the other shapes.

As mentioned in the above, according to the invention, the antenna can be fitted to the casing efficiently and certainly, ricketiness of the antenna fitted to the casing can be eliminated, and the structure for supporting the antenna having the excellent waterproof property can be provided.

What is claimed is:

1. A structure for supporting an antenna, comprising:

a radiator for radiating an electric wave;

an antenna-supporting member, which is formed under said radiator and shaped into a cylinder;

an antenna-inserting portion, which is formed in a wall of a casing and includes a first cylindrical space for accommodating said antenna-supporting member;

locking claws, which are connected with a lower end of said antenna-supporting member and interlocked with a lower edge of an inner wall of said first cylindrical space; and a rubber bush, which includes a through hole, through which said antenna-supporting member passes and is inserted between said radiator and said antenna-inserting portion, wherein said radiator is positioned directly on said rubber bush.

2. A structure for supporting an antenna according to claim 1, wherein dimensions of said radiator, said antenna-supporting member, and said rubber bush are selected so that said rubber bush is compressed by said radiator and said antenna-supporting member.

3. The structure according to claim 1, wherein an upper part of said antenna-inserting portion said upper part comprises a second cylindrical space to accommodate said rubber bush.

4. The structure according to claim 1, wherein said rubber bush comprises a ring-shaped convex portion.

5. The structure according to claim 1, wherein said rubber bush comprises an elastic material.

6. The structure according to claim 1, wherein said rubber bush applies a tension upwardly on said antenna supporting member to interlock said locking claws to said lower edge of said first cylindrical space.

7. The structure according to claim 1, wherein an upper part of said antenna-inserting portion includes a second cylindrical space, which is concentric with said first cylindrical space, and has a predetermined depth and an internal diameter larger than those of said first cylindrical space.

8. The structure according to claim 7, wherein a lower part of said rubber bush fits into said second cylindrical space.

9. The structure according to claim 1, wherein said through hole includes a diameter smaller than a diameter of said antenna-supporting member.

10. The structure according to claim 1, wherein said rubber bush is partially exposed outside of said casing.

11. The structure according to claim 1, wherein said rubber bush is entirely surrounded by said casing.

12. The structure according to claim 1, wherein said antenna inserting portion comprises a second cylindrical space, and said rubber bush includes a diameter larger than an inner diameter of said second cylindrical space.

13. The structure according to claim 12, wherein said second cylindrical space comprises an inner diameter, and wherein said rubber bush comprises a ring-shaped convex portion with an external diameter, said external diameter being larger than said inner diameter of said second cylindrical space.

14. A structure for supporting an antenna comprising:

a radiator for radiating an electric wave;

an antenna-supporting member, which is formed under said radiator and shaped into a cylinder;

an antenna-inserting portion, which is formed in a wall of a casing and includes a first cylindrical space for accommodating said antenna-supporting member;

locking claws, which are connected with a lower end of said antenna-supporting member and interlocked with a lower edge of an inner wall of said first cylindrical space; and a rubber bush, which includes a through hole, through which said antenna-supporting member passes and is inserted between said radiator and said antenna-inserting portion, wherein an upper part of said antenna-inserting portion includes a second cylindrical space, which is concentric with said first cylindrical space, and has a predetermined depth and an internal diameter larger than that of said first cylindrical space, and a lower part of said rubber bush fits into said second cylindrical space.

15. The structure for supporting an antenna according to claim 14, wherein a ring-shaped convex portion is formed on a periphery of said lower part of said rubber bush, and wherein an internal diameter of said ring-shaped convex portion is larger than that of said through hole of said rubber bush.

16. The structure for supporting an antenna according to claim 15, wherein a circular groove is formed on a bottom surface of said second cylindrical space and along an inner periphery thereof, and wherein said ring-shaped convex portion of said rubber bush fits into said circular groove.

17. A structure for supporting an antenna, comprising:

a radiator for radiating an electric wave;

an antenna-supporting member formed adjacent said radiator;

an antenna-inserting portion including a first cylindrical space formed in a wall of a casing for accommodating said antenna-supporting member;

locking claws connected with a lower end of said antenna-supporting member and interlocked with said first cylindrical space; and a rubber bush, including a through hole through which said antenna-supporting member passes, inserted between said radiator and said antenna-inserting portion, wherein said rubber bush comprises a portion which fits into an upper part of said antenna-inserting portion.

18. The structure for supporting an antenna according to claim 17, wherein said portion of said rubber bush comprises a ring-shaped convex portion formed on a periphery of a lower part of said rubber bush.

19. The structure according to claim 17, wherein said upper part comprises a circular groove formed on a bottom surface of said upper part and along an inner periphery thereof, and wherein said ring-shaped convex portion fits into said circular groove.

20. A structure for supporting an antenna, comprising:

a radiator for radiating an electric wave;

an antenna-supporting member formed under said radiator;

an antenna-inserting portion, which is formed in a casing and includes a first cylindrical space for accommodating said antenna-supporting member;

locking claws connected with a lower end of said antenna-supporting member and interlocked with an inner wall of said first cylindrical space; and a rubber bush, including a through hole through which said antenna-supporting member passes, inserted between said radiator and said antenna-inserting portion, wherein an upper part of said antenna-inserting portion includes a second cylindrical space, which is concentric with said first cylindrical space, and has an internal diameter larger than that of said first cylindrical space, and a lower part of said rubber bush fits into said second cylindrical space.

* * * * *